US005171014A

United States Patent [19]

Hsieh

[11] Patent Number: 5,171,014

[45] Date of Patent: Dec. 15, 1992

[54] MAGIC FOLDING GAME

[76] Inventor: Jung-Yao Hsieh, 2F, No. 216, Sec. 2, Kuei Yang Street, Taipei, Taiwan

[21] Appl. No.: 706,175

[22] Filed: May 28, 1991

[51] Int. Cl.[5] ..... A63F 9/12; A63H 33/16

[52] U.S. Cl. ..... 273/157 R; 446/488; 446/388; 446/125; 446/108

[58] Field of Search ..... 434/406, 213, 216; 446/79, 80, 108, 109, 114, 115, 122, 124, 125, 127, 388, 488; 273/153 R, 155, 156, 157 R; 52/DIG. 10; 428/33

[56] References Cited

U.S. PATENT DOCUMENTS

| | | | |
|---|---|---|---|
| 1,569,427 | 1/1926 | Kurtz | 446/109 X |
| 1,999,940 | 4/1935 | MacDonald | 446/488 X |
| 3,562,077 | 2/1971 | Raba | 446/125 X |
| 3,578,331 | 5/1971 | De Gast | 273/157 R |
| 3,654,052 | 4/1972 | Rye | 446/108 X |
| 3,895,229 | 7/1975 | Strom | 446/108 X |
| 3,917,153 | 11/1975 | Holschneider | 446/488 X |
| 4,666,163 | 5/1987 | Hirschfeld | 273/157 R X |
| 4,976,652 | 12/1990 | Schwartz | 273/157 R X |

*Primary Examiner*—Vincent Millin
*Assistant Examiner*—William M. Pierce
*Attorney, Agent, or Firm*—Bacon & Thomas

[57] ABSTRACT

A magic folding game includes a plurality of different folders each in the form of a combination of two right polygons having a joining line in the middle, in which the joining line is a side of both the polygons. From each side of the joining line, lateral edges are extended symmetrically and, the inclined angle between the joining line and each of the lateral edges is the internal angle of the pentagons, the extension of each of the lateral edges passing through the center of a pentagon to form a junction. Assembly of a plurality of folders can form a spheroid through interlacing of their respective connection arcs in either a clockwise or counterclockwise direction such that a lateral edge of one folder is aligned with the joining line of another folder.

5 Claims, 7 Drawing Sheets

MAGIC FOLDING GAME

BACKGROUND OF THE INVENTION

The present invention relates to a folding game, particularly a game to form a spheroid by assembly of a plurality of folding members.

There are many kinds of folding or assemble games in the market, such as the magic cube, puzzler, and so forth. They are all designed to meet the need for challenge in modern life and the need for novelty.

In view of the above needs, the inventor created a magic folding game which has the following features:

(1) Each folding member is in the form of a combination of two polygons with a joining line, from which connection arcs are extended for interlacing in a clockwise or counterclockwise direction so that assembly of a plurality of such folding members can form a spheroid.

(2) Each folding member can be in the form of a combination of two different polygons, such as a triangle, square, pentagon, hexagon, octagon, and so forth.

(3) Clockwise or counterclockwise interlacing of the connection arcs can provide a firm assembly to form a spheroid without use of any adhesive.

(4) Making of a spheroid with a plurality of folding members requires some degree of intelligence and patience.

(5) The folding member is of simple structure, easy to make, and can be made in different combinations of polygons.

SUMMARY OF THE INVENTION

The main objective of the present invention is to provide a magic folding game which includes a plurality of folders in different forms each in the form of a combination of two right polygons having a joining line in the middle, in which the joining line is a side of both the polygons. From each side of the joining line, lateral edges are extended symmetrically and, the included angle between the joining line and each of the lateral edges is the internal angle of the pentagons, the extension of each of the lateral edges passing through the center of a pentagon to form a junction. Assembly of a plurality of folders can form a spheroid through interlacing of their respective connection arcs in either a clockwise or counterclockwise direction such that a lateral edge of one folder is aligned with a joining line of another folder.

BRIEF DESCRIPTION OF THE DRAWINGS

FIG. 2 illustrates the assemble of the 5—5 folders according to the present invention.

FIG. 5 illustrates the assembly of a 6—6 folder and a 6-4 folder according to the present invention.

DETAILED DESCRIPTION OF THE PREFERRED EMBODIMENT

Figure 1:
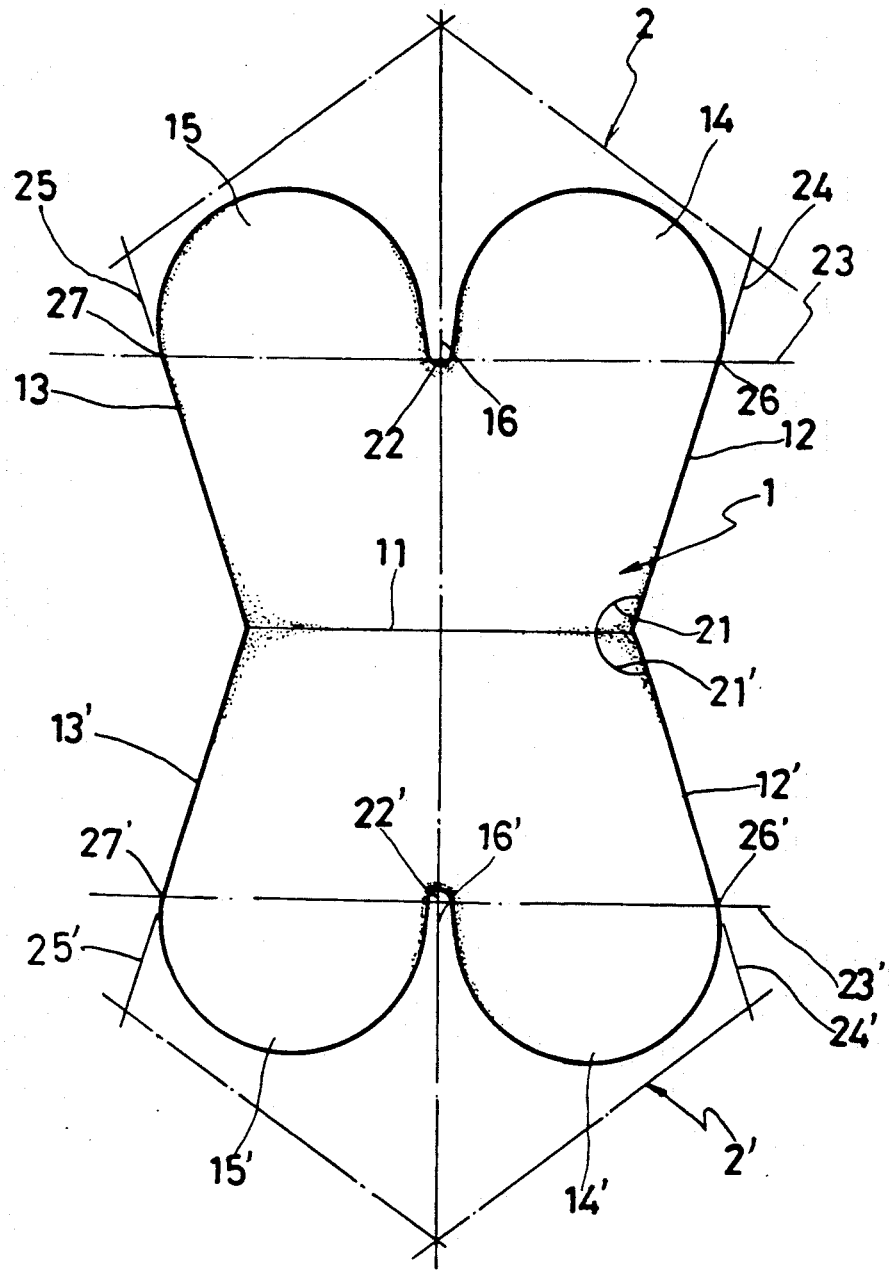
FIG. 1 is a developed view of a 5—5 folder according to the present invention.

As shown in FIG. 1, the folding member (1) according to the present invention is in the form of a combination of two pentagons (2 and 2'), on which the joining line (11) between these two pentagons (2 and 2') is the length of each side of the pentagons. From each side of the joining line (11) lateral edges (12, 13, 12' and 13') are extended symmetrically. The included angle between the joining line and each of the lateral edges (12, 13, 12', and 13') is the internal angle (21 or 21') of the pentagons (2 and 2'). The extension of each of the lateral edges (12, 13, 12' and 13') passes through the center O (22 or 22') of a pentagon (2 or 2'). A line L (23 or 23') parallel to the joining line (11) intersects each lateral edge (12, 13, 12' or 13') at an intersection point B (26, 27, 26' and 27'). Each lateral edge (12, 13, 12' or 13') is extended inwards from an intersection point B (26, 27, 26' or 27') to form a symmetric connection arc (14, 15, 14' or 15'). Respective ends of extension of connection arcs (14 and 15, or 14' and 15') meet at the centers (22 or 22') of the pentagons (2 or 2') to form a folding member (1) as shown in FIG. 1, which is called a 5—5 folder according to the present invention to imply that it is in the form of a combination of two pentagons. These 5—5 folders (1) can be folded to become a spheroid in the manner described below.

Figure 2A:
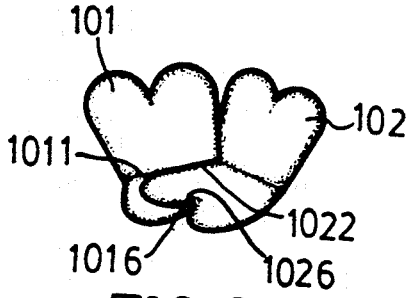
FIGS. 2A through 2H illustrate the assembly method of the 5—5 folders according to the present invention.
Figure 2B:
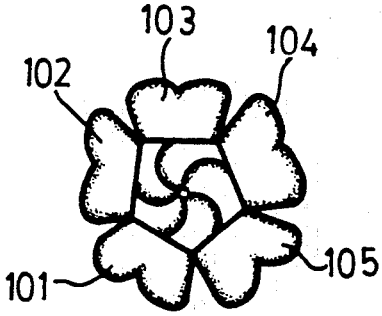
Figure 2C:
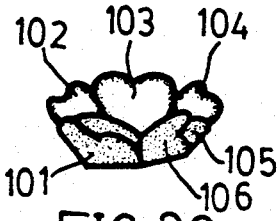
Figure 2D:
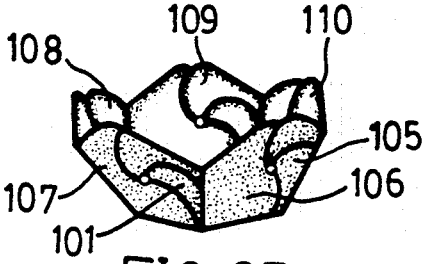
Figure 2E:
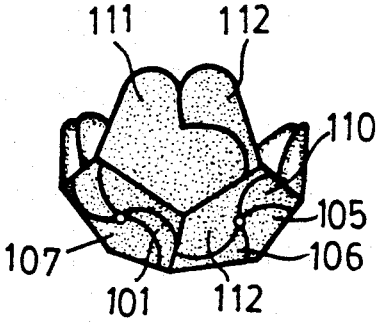
Figure 2F:
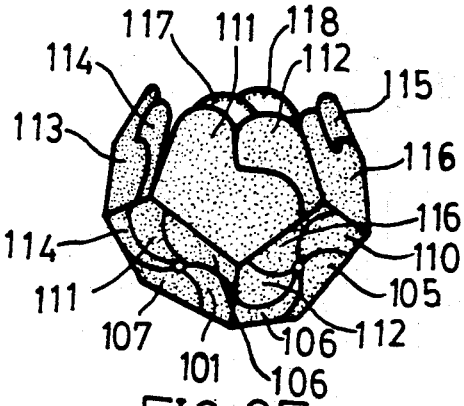
Figure 2G:
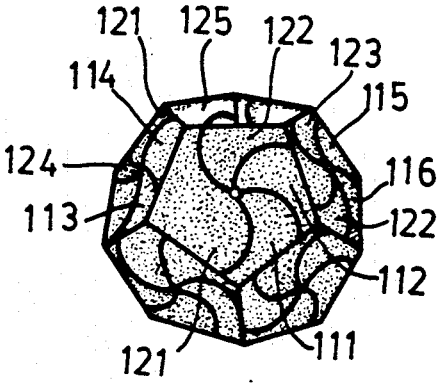
Figure 2H:
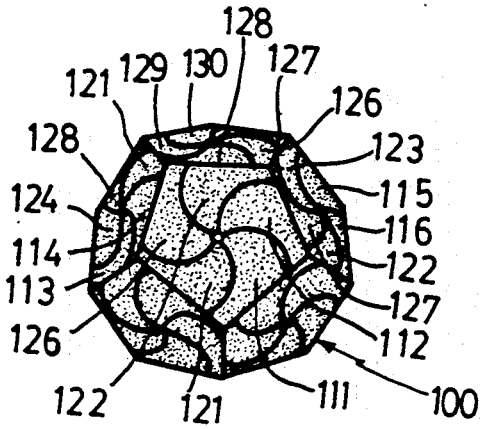

As shown in FIGS. 2A-2H, the spheroid (100) according to the present invention is formed by 30 pieces of 5—5 folders (101 to 130). As shown in FIG. 2A, the connection arcs can be folded and connected together either in a clockwise or counterclockwise direction. If the clockwise direction is elected, then all the connection arcs must be connected together in the clockwise direction, and vice versa, otherwise, the spheroid formed will not be firm enough. In the description here the connection arcs are connected together in a counterclockwise direction. A 5—5 folder (101) is connected to another 5—5 folder (102) with their respective arc junctions (1016 and 1026) interlaced with each other in such a manner that the lateral edge (1022) of the folder (102) is aligned with the joining line (1011) of the folder (101). Another three folders (103 to 105) are connected to them in the same manner to form a component as shown in FIG. 2B. As shown in FIG. 2C, the component is composed of five folders (101 to 105) arranged symmetrically, and a folder (106) can be connected to the junction between the folder (101) and another folder (105). FIG. 2D illustrates the assembly of some folders (107 to 110) to the component in the way same with that for the folder (106) in FIG. 2C. As shown in FIG. 2E, after assembly of the folders (107 to 110), the folders (111 and 112) are interlaced with the folders (101 to 110). FIG. 2F illustrates the assembly of the folders (113 to 116), which is done in the same manner for the folders (111 and 112) shown in FIG. 2E. As shown in FIGS.

2G and 2H, the folders (121 to 130) are interlaced in the manner described above to form a spheroid (100).

Figure 3:
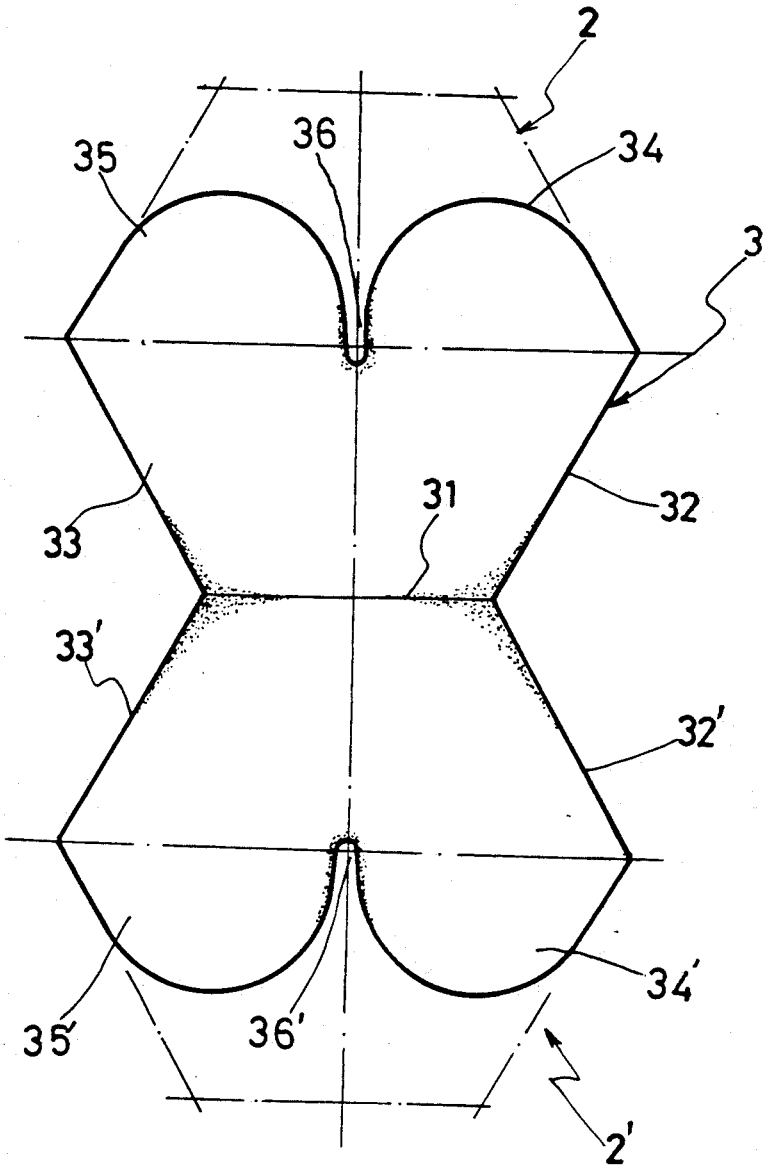
FIG. 3 is a developed view of a 6—6 folder according to the present invention.
Figure 4:
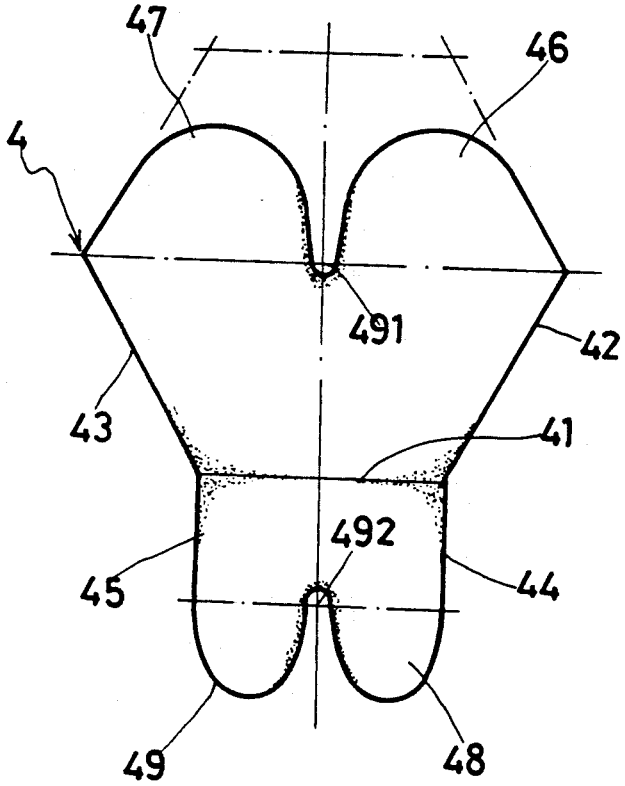
FIG. 4 is a developed view of a 6-4 folder according to the present invention.

The present invention can also be embodied by a folder designed in the form of a combination of two different polygons, as shown in FIGS. 3 and 4, a 6—6 folder (3), and a 6-4 folder (4). Each of the 6—6 folder (3) and the 6-4 folder (4) has a joining line (31 or 41), lateral edges (32, 32', 33 and 33' or 42, 43, 44 and 45), connection arcs (34, 35, 34' and 35' or 46, 47, 48 and 49), and arc junctions (36 and 36', or 491 and 492), all corresponding to the joining line (11), lateral edges (12, 13, 12' and 13'), connection arcs (14, 15, 14' and 15'), and the junctions (16 and 16') in the 5—5 folder (1) shown in FIG. 1. Another form of spheroid (300) can be made by assembly of 6—6 folders (3) and 6-4 folders (4).

Figure 5A:
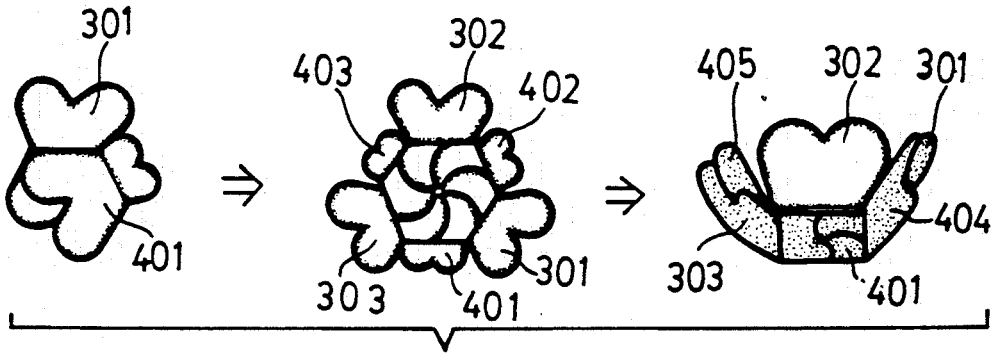
FIGS. 5A through 5G the assembly method of the 6—6 folders and 6-4 folders according to the present invention.
Figure 5B:
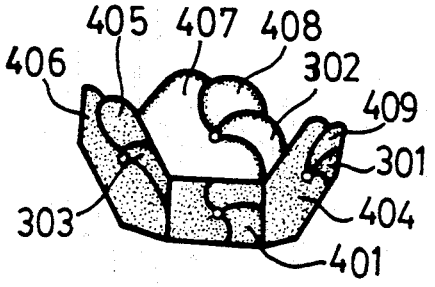
Figure 5C:
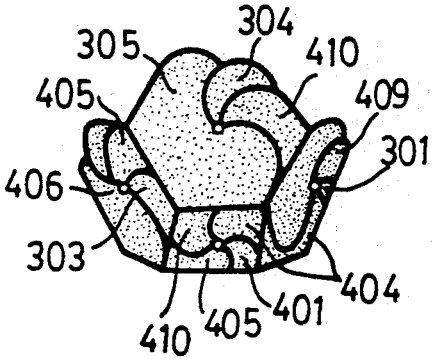
Figure 5D:
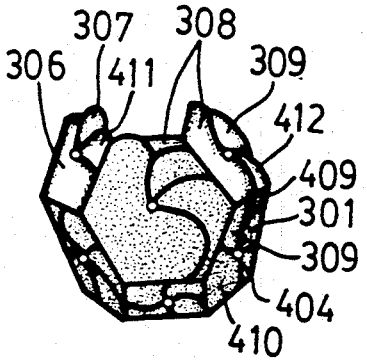
Figure 5E:
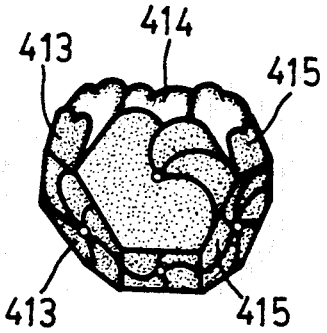
Figure 5F:
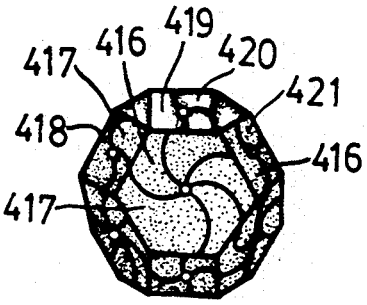
Figure 5G:
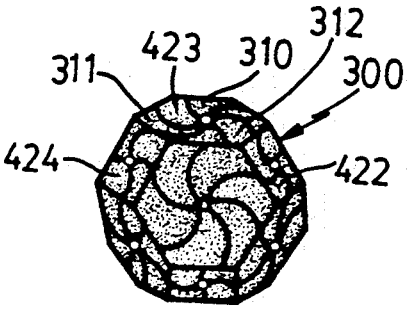
Figure 6:
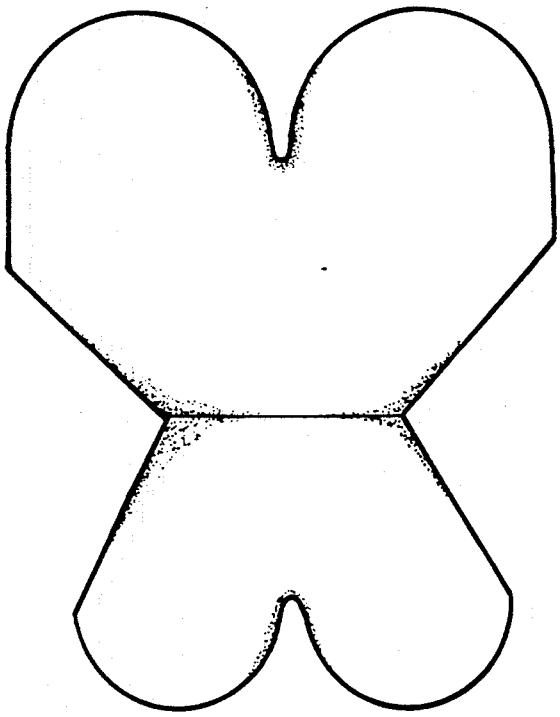
FIG. 6 is a developed view of a 8-6 folder according to the present invention.
Figure 7:
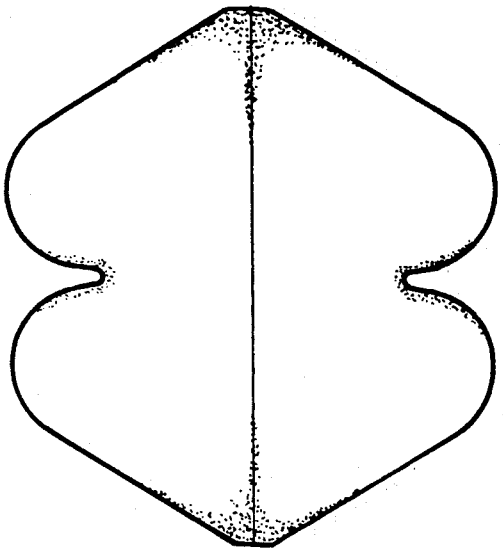
FIG. 7 is a developed view of a 3—3 folder according to the present invention.
Figure 8:
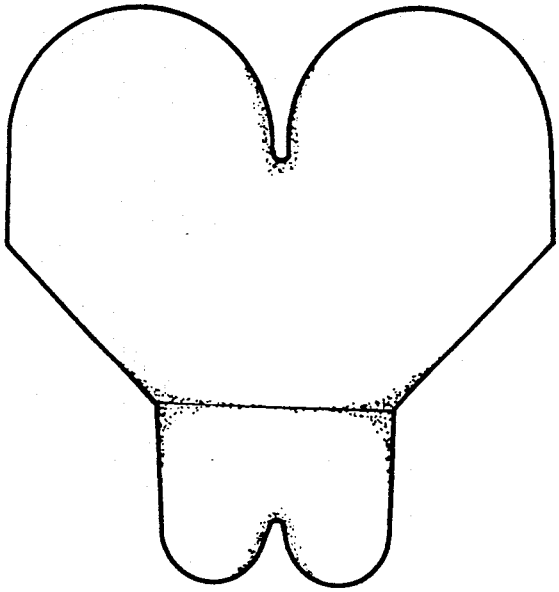
FIG. 8 is a developed view of a 8-4 folder according to the present invention.
Figure 9:
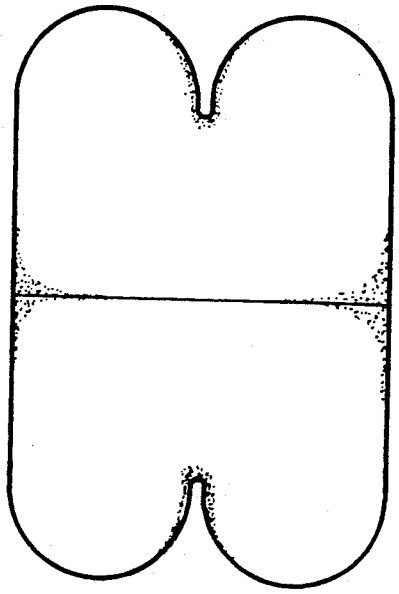
FIG. 9 is a developed view of a 4—4 folder according to the present invention.
Figure 10:
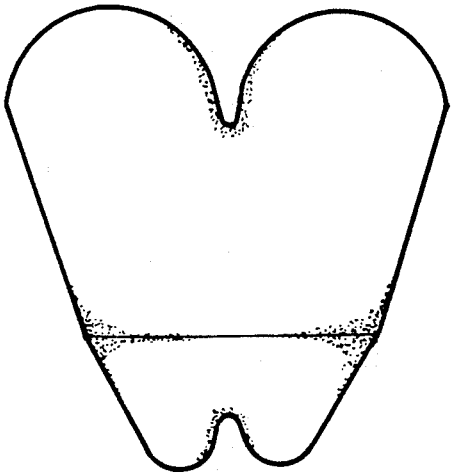
FIG. 10 is a developed view of a 5-3 folder according to the present invention.

As shown in FIGS. 5A-5G, the spheroid (300) is an assembly of twelve pieces of 6—6 folders (301 to 312) and twenty four pieces of 6—6 folders (401 to 424). As shown in FIG. 5A, the connection arcs are connected together in either clockwise or anticlockwise direction in the same manner for the 5—5 folders described above. In this example, connection in the anticlockwise direction is described. A 6—6 folder (301) and a 6-4 folder (401) are interlaced to form a component shown on the left in FIG. 5A. The component in the middle of FIG. 5A formed by interlacing of three 6—6 folders (301 to 303) and three 6-4 folders (401 to 403). The component on the right in FIG. 5A requires connecting a hexagon to another hexagon, and a square to another square, such that two 6-4 folders (404 and 405) are connected together. FIGS. 5A and 5B illustrate the assembly of 6-4 folders (404 to 409). With their symmetric structure, the manner for interlacing the 6-4 folders (406 to 409) in FIG. 5B is identical to that for the 6-4 folders (404 and 405) in FIG. 5A. As shown in FIG. 5C, the 6-4 folder (410) is interlaced with the 6—6 folders (304 and 305). As shown in FIG. 5D, the assembly of the 6-4 folders (411 and 412) to the 6—6 folders (306 to 309) is identical to that for assembly of the 6-4 folder (410) to the 6—6 folder (305) shown in FIG. 5C. As shown in FIGS. 5E, 5F and 5G, the 6-4 folders (413 to 424) are interlaced with the 6—6 folders (310 to 312) in the manner described above to form a spheroid (300).

The folder according to the present invention can utilize a combination of any two different polygons, such as a triangle square, pentagon, hexagon, octagon, and so forth, to form such combined polygons as the 8-6 folder, 3—3 folder, 8-4 folder, 4—4 folder, respectively and 5-3 folder shown in FIGS. 6 to 10 in accordance with the same principles described above in connection with the design of the 5—5 folder. Because of the numerous variations of the invention which are possible, it is intended that the invention be defined solely in accordance with the appended claims.

I claim:

1. A magic folding game comprising a plurality of folders each in the form of a portion of a combination of two regular polygons joined at a joining line which forms a common side of both polygons, each of said polygons having a center, said folders having lateral edges extending from the joining line, one of said edges and the joining line forming a first angle and the other of said edges and said joining line forming a second angle, said first and second angles being congruent such that said lateral edges extend symmetrically from said joining line, said lateral edges including portions of additional sides of said polygon which intersect said joining line, an extension of each of the lateral edges through a respective one of the centers of a respective one of the polygons, wherein a line parallel to the joining line intersects each lateral edge at an intersection point, each lateral edge extending towards the other from the intersection point to form a symmetric connection arc, the connection arcs having respective ends of extension meeting at the center of a respective one of the polygons, and wherein assembly of a plurality of folders forms a closed three-dimensional object having a plurality of planar surfaces, each of said planar surfaces having a number of sides equal to a number of sides of said polygons, the respective connection arcs being interlaced in either a clockwise or counterclockwise direction such that a lateral edge of one folder aligns with a joining line of another folder.

2. A magic folding game as claimed in claim 1, wherein said two polygons have different shapes.

3. A magic folding game as claimed in claim 1, wherein said two polygons have a different number of lateral edges.

4. A magic folding game as claimed in claim 1, wherein at least one of said polygons is a pentagon.

5. A magic folding game as claimed in claim 1, wherein both of said polygons are pentagons.

* * * * *